US008287051B2

(12) United States Patent
Lahdelma

(10) Patent No.: US 8,287,051 B2
(45) Date of Patent: Oct. 16, 2012

(54) METHOD OF QUARRYING DIMENSIONAL STONE, AND LINE DRILLING APPARATUS

(75) Inventor: Ilkka Lahdelma, Kangasala (FI)

(73) Assignee: Sandvik Mining and Construction Oy, Tampere (FI)

( * ) Notice: Subject to any disclaimer, the term of this patent is extended or adjusted under 35 U.S.C. 154(b) by 353 days.

(21) Appl. No.: 12/602,574

(22) PCT Filed: Jun. 4, 2008

(86) PCT No.: PCT/FI2008/050332

§ 371 (c)(1),
(2), (4) Date: Dec. 1, 2009

(87) PCT Pub. No.: WO2008/148939

PCT Pub. Date: Dec. 11, 2008

(65) Prior Publication Data

US 2010/0141012 A1 Jun. 10, 2010

(30) Foreign Application Priority Data

Jun. 5, 2007 (FI) ..... 20075413

(51) Int. Cl.
*E21B 7/02* (2006.01)

(52) U.S. Cl. ..... 299/10; 299/15; 173/1

(58) Field of Classification Search ..... 173/1; 299/10, 299/15

See application file for complete search history.

(56) References Cited

U.S. PATENT DOCUMENTS

| | | | | |
|---|---|---|---|---|
| 4,890,680 | A * | 1/1990 | Porsfeld | 173/42 |
| 5,310,011 | A * | 5/1994 | Kaakkurivaara | 173/194 |
| 6,076,615 | A * | 6/2000 | Dalland et al. | 173/42 |
| 2004/0069917 | A1 | 4/2004 | Osen | |

FOREIGN PATENT DOCUMENTS

| | | |
|---|---|---|
| EP | 0 551 299 | 1/1997 |
| JP | 2000-303768 | 10/2000 |

OTHER PUBLICATIONS

Korean Office Action issued on Mar. 2, 2012 in a corresponding Korean patent application.

* cited by examiner

*Primary Examiner* — John Kreck
(74) *Attorney, Agent, or Firm* — Morgan, Lewis & Bockius LLP

(57) ABSTRACT

A method of quarrying dimensional stone and a line drilling apparatus used therein. The drilling apparatus is frameless and comprises a first boom and a second boom, between which is arranged a joint mechanism, allowing the booms to be moved relative to each other. Furthermore, in connection with the joint mechanism is arranged a stone support adaptable against the stone once the drilling apparatus is coarse-positioned in the vicinity of a drill hole line. Fine positioning of the drilling apparatus in the direction of the drill hole line is performed by joints comprised by the joint mechanism. Positioning at drill holes takes place by turning the second boom along an arched motion path and by turning the drilling unit towards the stone to be drilled.

11 Claims, 4 Drawing Sheets

METHOD OF QUARRYING DIMENSIONAL STONE, AND LINE DRILLING APPARATUS

CROSS REFERENCE TO RELATED APPLICATIONS

This application is the National Stage of International Application No. PCT/FI2008/050332, filed Jun. 4, 2008, and claims benefit of Finnish Application No. 20075413, filed Jun. 5, 2007.

BACKGROUND OF THE INVENTION

The invention relates to a method of quarrying dimensional stone, the method comprising drilling a plurality of drill holes in a rock or a stone block in at least one drill hole line, at a desired hole spacing from each other. For the drilling, a line drilling device is used, which comprises a boom provided with a drilling unit, which, in turn, comprises a rock drilling machine, a feed beam and a feeding apparatus. In frameless line drilling, the drilling unit is positioned in the drill hole line by means of the boom from a drilled drill hole to a drill hole to be drilled next. After the drilling, a dimensional stone block is detached from a position determined by the drill hole lines for further processing. The invention further relates to a line drilling apparatus for quarrying dimensional stone.

The objects of the invention are defined more precisely in the preambles of the independent claims of the application.

High-quality rock is detached from a rock in large blocks, which are split into the desired smaller blocks. Transportable dimensional stone blocks are transported from the excavation site for further processing into interior decoration tiles, table levels, tombstones and corresponding products. For detaching dimensional stone, one or more drill hole lines are drilled in the rock. After the drilling, the dimensional stone block can be detached by blasting or by means of wedges. The dimensional stone block is split in a corresponding manner. The drilling is carried out with a line drilling device, which conventionally comprises a mechanical frame that is positioned in the direction of the hole line to be drilled and controls the drilling unit from one hole to another. However, such a drilling device comprising a frame is heavy, clumsy and has a complex structure. Accordingly, a frameless line drilling device has been developed. The device disclosed in publication EP-0 551 299-B1, for example, comprises a boom, a drilling unit being arranged at its outermost end. The drilling unit is positioned in the drill line at the starting point of the hole to be drilled first and the starting point of the hole to be drilled last, and, in addition, a hole spacing is given, after which the control unit of the drilling device positions the drilling unit by means of the boom at the starting locations of the drill holes to be drilled. However, a disadvantage of this solution is that the positioning of the drilling unit at the starting points of the starting and finishing hole of the drill hole line to be drilled is slow. Furthermore, the drilling unit is located at the outermost end of a relatively long boom, making the exact positioning of the boom difficult.

BRIEF DESCRIPTION OF THE INVENTION

It is the object of the present invention to accomplish a novel and improved method of quarrying dimensional stone, and a novel and improved line drilling apparatus suited thereto.

The method of the invention is characterized by using a line drilling apparatus comprising a first boom, a second boom, a substantially horizontal first joint between the booms and a substantially horizontal second joint between the second boom and the drilling unit; supporting a stone support between the first boom and the second boom against the stone; performing positioning of the line drilling apparatus to the vicinity of a drill hole line so that the first joint and the second joint are in perpendicular alignment relative to the drill hole line to be drilled and keeping this position unchanged until the drilling is completed; performing positioning of the drilling unit between the drill holes belonging to the drill hole line by turning the second boom around the first joint, whereby the second boom moves only in the direction of the drill hole line and the drilling unit in the second boom turns along an arched motion path; and adjusting the position of the drilling unit, at each drill hole to be drilled, relative to the object to be drilled by turning the drilling unit relative to the second joint.

The line drilling apparatus of the invention is characterized in that the apparatus comprises a first boom and a second boom; between the booms is arranged a joint mechanism comprising at least one substantially horizontal first joint around which the second boom is turnable in a transverse direction relative to the longitudinal axis of the first boom; between the first boom and the second boom is arranged at least one stone support that is supportable against rock to be drilled for the duration of the drilling; between the second boom and the drilling unit is arranged a substantially horizontal second joint around which the drilling unit is turnable relative to the second boom; the second boom is a longitudinal element without any joints between the first joint and the second joint; the positioning of the drilling unit at the drill holes according to a drill hole line is arranged to be carried out by turning the second boom only in the direction of the drill hole line; and the position of the drilling unit at each drill hole to be drilled is arranged to be set by turning the drilling unit relative to the second boom.

The idea of the invention is to use a frameless line drilling device in quarrying dimensional stone, the device comprising a first and a second boom that are coupled together by means of a joint mechanism. The portion between the booms further comprises a stone support that can be positioned against rock during movement of the second, i.e. outermost, boom and the drilling. Further, the idea is to position the second boom so that it can be moved only in the direction of the drill hole line. This position is kept until the drilling is completed. The drilling unit is moved between the drill holes belonging to a drill hole line by turning the second boom around the substantially horizontal first joint, making the drilling unit in the second boom turn along an arched motion path. Further, the position of the drilling unit relative to the object to be drilled is adjusted at each drill hole to be drilled by turning the drilling unit relative to a second, substantially horizontal joint, which is arranged between the second boom and the drilling unit.

An advantage of the invention is that the positioning of the drilling unit at the drill holes to be drilled can be carried out by simple turning movements, and the positioning does not require any complex calculation in the control unit. After the first joint and the second joint of the second boom have been positioned perpendicularly relative to the drill hole line, the second boom is moved in the direction of the drill hole line, which makes the control more simple and accurate.

The idea of an embodiment is that the second boom is a one-piece rigid element. In this embodiment, the second boom is very simple in structure, which makes it easy to manufacture and durable. Moreover, this kind of boom is easy to control.

The idea of an embodiment is that all the other joints belonging to the line drilling apparatus except the first joint and the second joint are kept stationary during the positioning carried out in the drill hole line by moving the second boom in the direction of the drill hole line.

The idea of an embodiment is that a linear joint, i.e. a so-called zoom, is arranged in connection with the joint mechanism between the first boom and the second boom, the joint enabling the simultaneous movement of the second boom and the drilling unit in a linear direction relative to the first boom. This also enables the performance of a fine positioning in the linear direction, even if the first boom were already supported by means of the stone support and kept stationary.

The idea of an embodiment is that at least one substantially vertical joint, i.e. a so-called rollover joint, is arranged in connection with the joint mechanism between the first boom and the second boom, around which joint the second boom and the drilling unit are simultaneously turnable by means of a turning device. This joint enables the simple placement of the drilling unit in the direction of the drill hole line to be drilled.

The idea of an embodiment is that at least one horizontal joint facilitating the coarse positioning of the drilling apparatus is arranged between the first boom and the joint mechanism.

The idea of an embodiment is that at least one horizontal joint is arranged between the second boom and the joint mechanism, allowing the second boom to be tilted relative to the stone to be drilled.

The idea of an embodiment is that the operator performs the coarse positioning from a control cabin or the like disposed on a carrier. Furthermore, the operator issues commands associated with the fine positioning, positioning at a drill hole and the drilling itself by means of a portable remote controller from the drilling site, from where the operator has good visibility to the drill hole line to be drilled.

BRIEF DESCRIPTION OF THE FIGURES

Some embodiments of the invention will be explained in more detail in the attached drawings, wherein FIG. 1 schematically shows the steps of quarrying dimensional stone, FIG. 2 schematically shows a side view of a line drilling apparatus of the invention arranged on a movable carrier, FIG. 3 schematically shows a side view of a joint mechanism between the booms of a line drilling apparatus of the invention, FIG. 4 schematically shows, seen from direction M, the positioning of a drilling unit in a drill hole line by turning the second boom along an arch, FIG. 5 schematically shows, seen obliquely from the front, part of a line drilling apparatus of the invention, and FIGS. 6*a* to 6*c* schematically show a front view of a line drilling apparatus of the invention turned in different positioning positions.

In the figures, some embodiments of the invention are shown in a simplified manner for the sake of clarity. In the figures, like parts are denoted with like reference numerals.

DETAILED DESCRIPTION OF SOME EMBODIMENTS OF THE INVENTION

Figure 1:
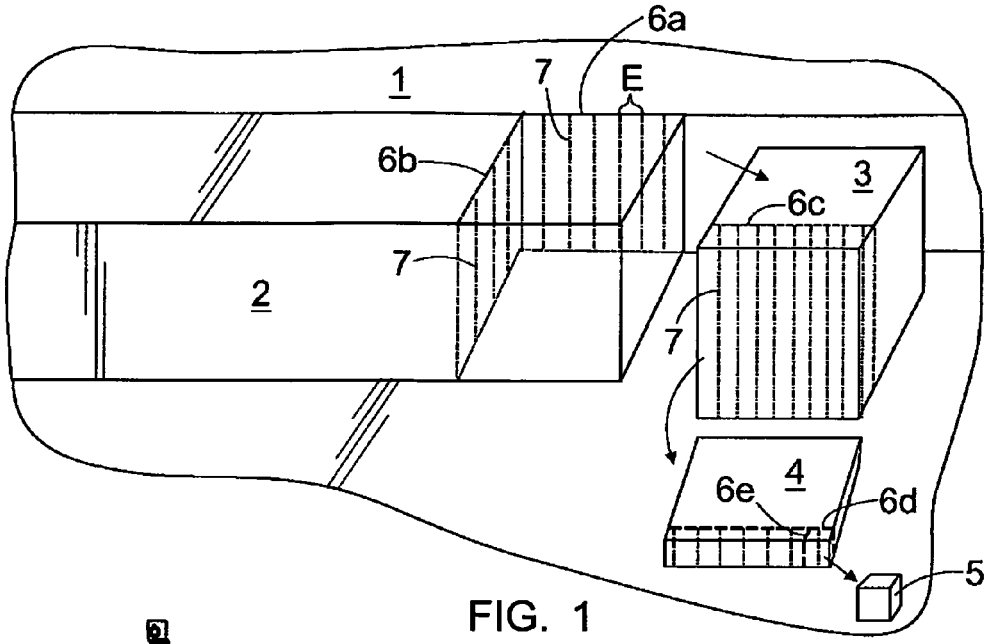

FIG. 1 shows a manner of quarrying dimensional stone from a rock 1. The quarrying site typically comprises a bench 2, from which a large stone block 3 is detached and split into smaller blocks 4 and, further, into transportable dimensional stone blocks 5. In the detachment of the large stone block 3 and in the splitting thereof into smaller pieces, either the same line drilling device can be used or, alternatively, special equipment may exist for the detachment and the splitting. In the quarrying of FIG. 1, a plurality of drill holes 7 having a relatively small diameter are drilled into the bench 2 from up downwards in a first drill hole line 6*a* and a second drill hole line 6*b* at a predetermined hole spacing E from each other. The drilling may be performed from a carrier, which may have been driven onto the bench for the duration of the drilling. Once the drilling steps have been performed, the large stone block 3 is detached from the bench 2 by blasting the explosives arranged in the drill holes 7. Once the large stone block 3 is detached, the chassis may be driven from the bench 2 on top thereof, after which the splitting can be initiated. At this point, a third drill hole line 6*c* may be drilled into the stone block 3, after which the block 4 can be detached by blasting or wedging. The block 4 may be keeled onto the ground, after which the splitting may be continued on the ground by drilling a fourth drill hole line 6*d* and a fifth drill hole line 6*e*. By again performing detachment at the drill hole lines, a dimensional stone block 5 can be formed, its size permitting it to be transported by means of a truck or the like, for example, to a further processing site. Let it be mentioned that instead of the solution shown in FIG. 1, the splitting may also be performed in some other suitable manner. The aim is to drill the drill holes of a drill hole line in an as straight line as possible in order for the dimensional stone block 4 to be generated to be as rectangular as possible, enabling the minimization of wasted stone. The aim is to split a cube or a rectangular prism from the dimensional stone block 4 as accurately as possible.

Figure 2:
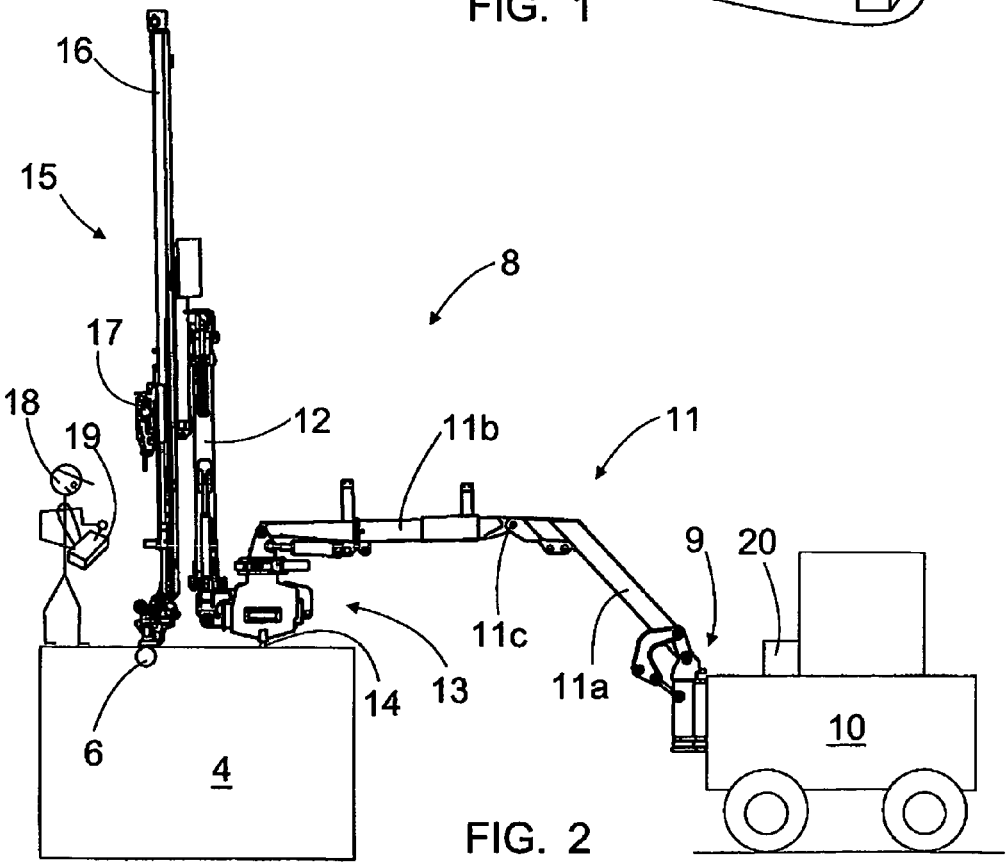

FIG. 2 illustrates the splitting of dimensional stone. A line drilling apparatus 8 may be fastened by means of a fastening part 9 to a movable carrier 10, an excavator or a mining vehicle, for example. Thus, the line drilling apparatus 8 may be a detachable apparatus. Alternatively, it may be integrated as part of the carrier 10. The line drilling apparatus 8 comprises a first boom 11 and a second boom 12. The first boom 11 may comprise a first boom portion 11*a* and a second boom portion 11*b*, between which is arranged at least one joint 11*c*, which enables the movement of the boom portions relative to each other. The second boom 12 may comprise only one part. The first boom 11 may be used to perform a coarse positioning of the apparatus to the vicinity of the drill hole line 6 to be drilled. The coarse positioning may be performed driven by the operator from the carrier 10, from a control cabin, for example. Between the first boom 11 and the second boom 12 is arranged a joint mechanism 13 comprising one or more joints enabling a versatile movement of the second boom 12 in a manner enabling a fine positioning of the drilling apparatus accurately in the direction of the drill hole line. Furthermore, between the first boom 11 and the second boom 12 is arranged a stone support 14 that is supportable against the stone after the coarse positioning is performed. The stone support 14 may be a spike or another suitable support member. Once the stone support 14 is supported in position, the first boom 11 is kept stationary and a fine adjustment of the position of the apparatus and the positioning at the holes to be drilled are performed by means of the joint mechanism 13 and the second boom 12. In the second boom 12, a drilling unit 15 is arranged turnably and it comprises at least a feed beam 16, along which a rock drilling machine 17 may be moved. The rock drilling machine 17 may be a percussion drilling machine that gives impact pulses to a tool coupled thereto and rotates the tool along its longitudinal axis during the drilling.

Naturally, the rock drilling machine 17 may be any other pneumatic, hydraulic or electric drilling machine suitable for the purpose. In some cases, the second boom 12 may be provided with two or more drilling units. It is further possible that two or more line drilling devices 8 are arranged on the carrier 10. FIG. 2 further shows that the operator 18 is able to control the operation of the apparatus by means of a remote controller 19, providing the operator 18 with a good visibility to the drill hole line 6 to be drilled. A wireless data transfer line may exist between the remote controller 19 and the control unit 20 on the chassis.

Figure 3:
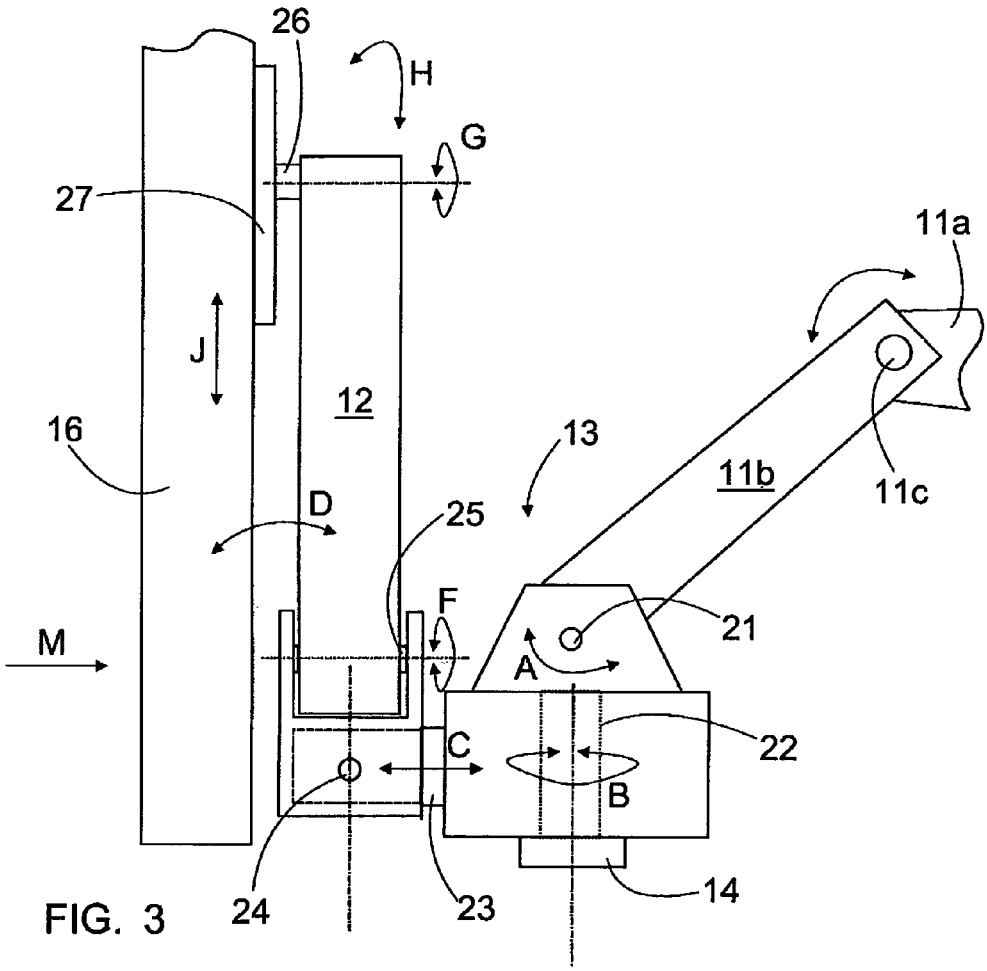

FIG. 3 shows a feasible structure of the joint mechanism 13 between the first boom 11 and the second boom 12. The second boom portion 11*b* of the first boom may be coupled to the joint mechanism 13 by means of a horizontal joint 21. This allows the height position of the line drilling apparatus 8 to be changed relative to the carrier. Furthermore, the joint mechanism 13 may comprise a vertical joint 22, which is a so-called rollover joint, by means of which the joint mechanism 13 is turned in direction B in a manner allowing the positioning to take place in the direction of the drill hole line 6. The turning around the joint 22 can be performed once the stone support 14 is arranged against the stone. In addition, the joint mechanism 13 may comprise a linear joint 23, i.e. a so-called zoom, which enables the simultaneous movement of the second boom 12 and the drilling unit 15 in a linear direction C relative to the first boom. The linear joint 23 facilitates the fine positioning of the line drilling apparatus 8, since the second boom 12 and the drilling unit 15 can be moved in direction C without having to move the first boom 11. The joint mechanism 13 may further comprise a horizontal joint 24 allowing the second boom 12 and the drilling unit 15 to be tilted in direction D. By means of the joint 24, the second boom 12 can be placed perpendicularly against the stone to be drilled.

Figure 4:
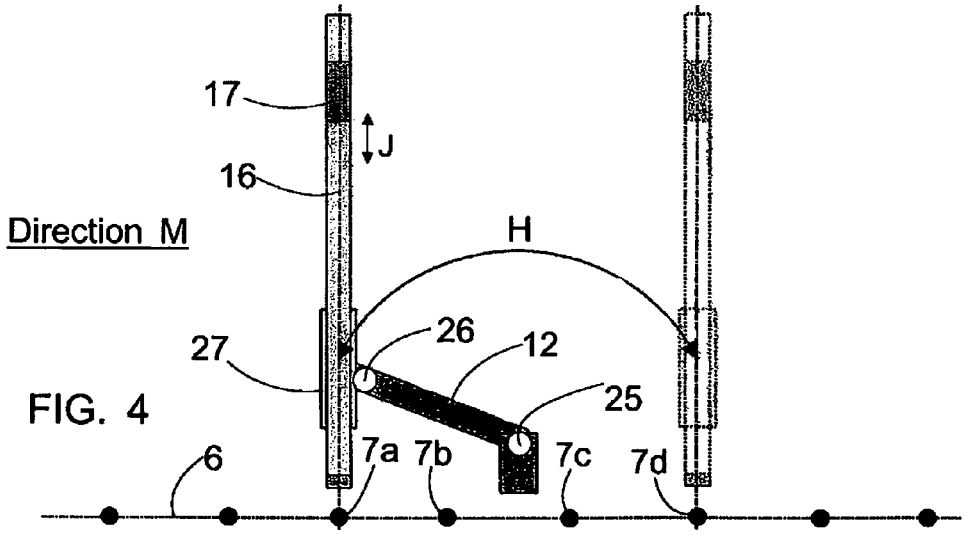

Between the second boom 12 and the joint mechanism 13 may be arranged a horizontal joint 25 enabling the turning of the second boom 12 in direction F, when the drilling unit 15 is being positioned at the drill hole 7 to be drilled in the drill hole line 6. In this case, the drilling unit 15 is arranged movable in direction H along an arch relative to the joint 25, at the same time as the joints 22, 23 and 24 of the joint mechanism 13 can be kept stationary. Once the fine positioning has been performed carefully, the second boom 12 moves in the direction of the drill hole line 6, as can be seen in FIG. 4. In this case, the positioning at drill holes 7*a* to 7*d* located within the reach of the drilling apparatus 8 takes place by a simple turning movement in direction H. In addition, between the second boom 12 and the drilling unit 15 is arranged a horizontal joint 26, allowing the drilling unit 15 to be turned in direction G in such a manner that it points towards the stone to be drilled irrespective of the turning angle of the second boom 12. Since the height position of the outermost end of the second boom 12 relative to the stone to be drilled changes as the second boom 12 is turned, the movement of the drilling unit 15 must be possible in a linear direction J relative to the end of the second boom 12 in the manner shown in FIG. 3. The feed beam 16 may be arranged by means of a linear joint such as a cradle 27 or the like in the joint 26.

FIG. 4 shows positioning of the drilling unit 15 at the drill holes 7*a* to 7*d* in a drill hole line, seen from direction M. The positioning takes place simply by turning the second boom 12 in direction H.

Figure 5:
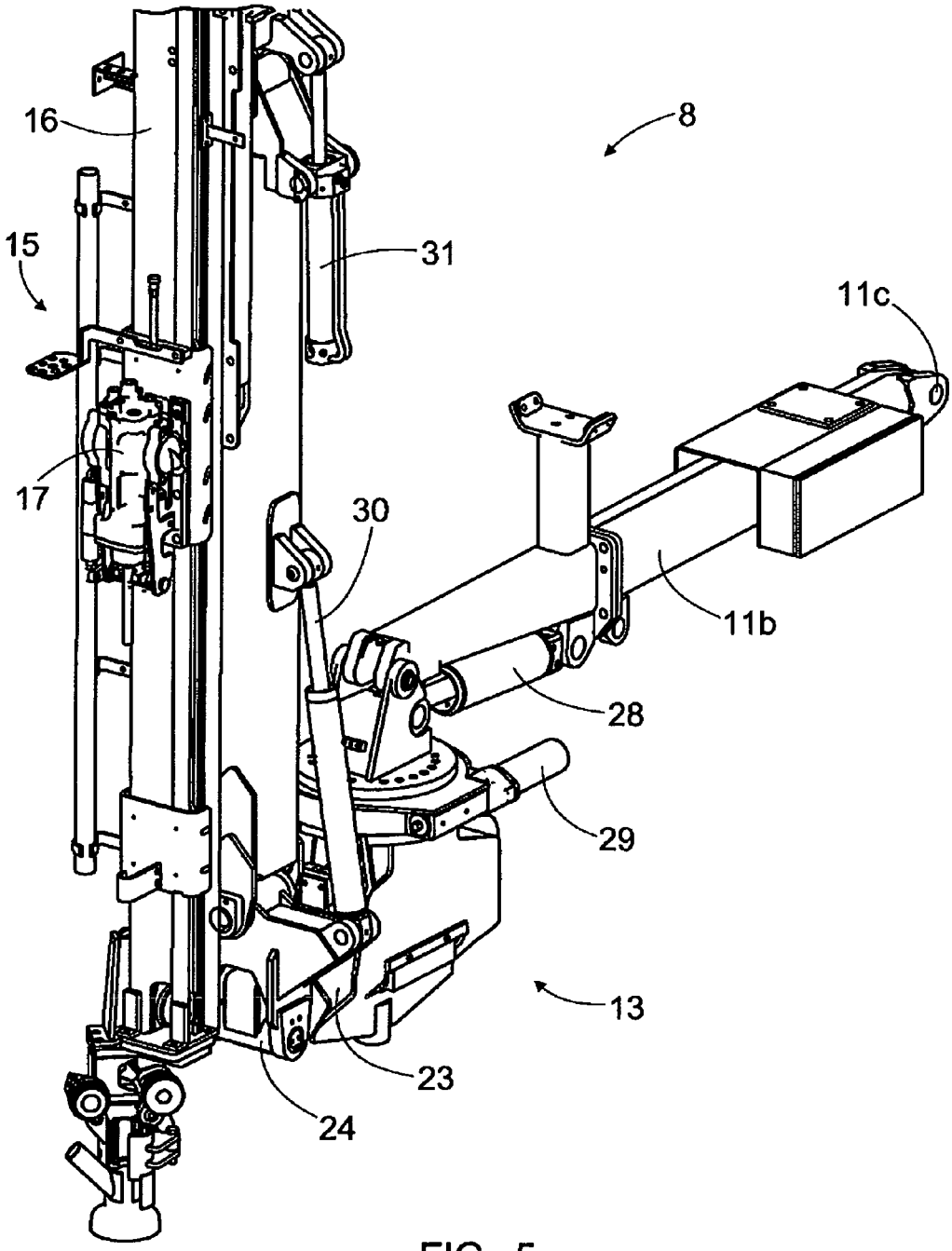

FIG. 5 shows a line drilling device 8 of the invention. FIG. 5 shows at least some actuators with which the drilling device 8 can be moved. The actuators may be pressure medium cylinders, pressure medium motors or any other actuators suitable for the purpose. The line drilling device 8 may comprise a first actuator 28, with which the joint mechanism 13 can be moved relative to the first boom 11. Furthermore, a second actuator 29 may be arranged in connection with the rollover joint 22. FIG. 5 does not show the actuator of the linear joint 23, the actuator of the tilting joint 24 or the actuator with which the feed beam 16 can be moved in the linear direction. However, FIG. 5 does show a third actuator 30 used for turning the second boom 12. In addition, the drilling unit 15 may be turned relative to the second boom 12 with a fourth actuator 31. Later on, FIGS. 6*a* to 6*c* further show an actuator 32 for moving the rock drilling machine 17 on the feed beam 16.

Figures 6A, 6B, 6C:
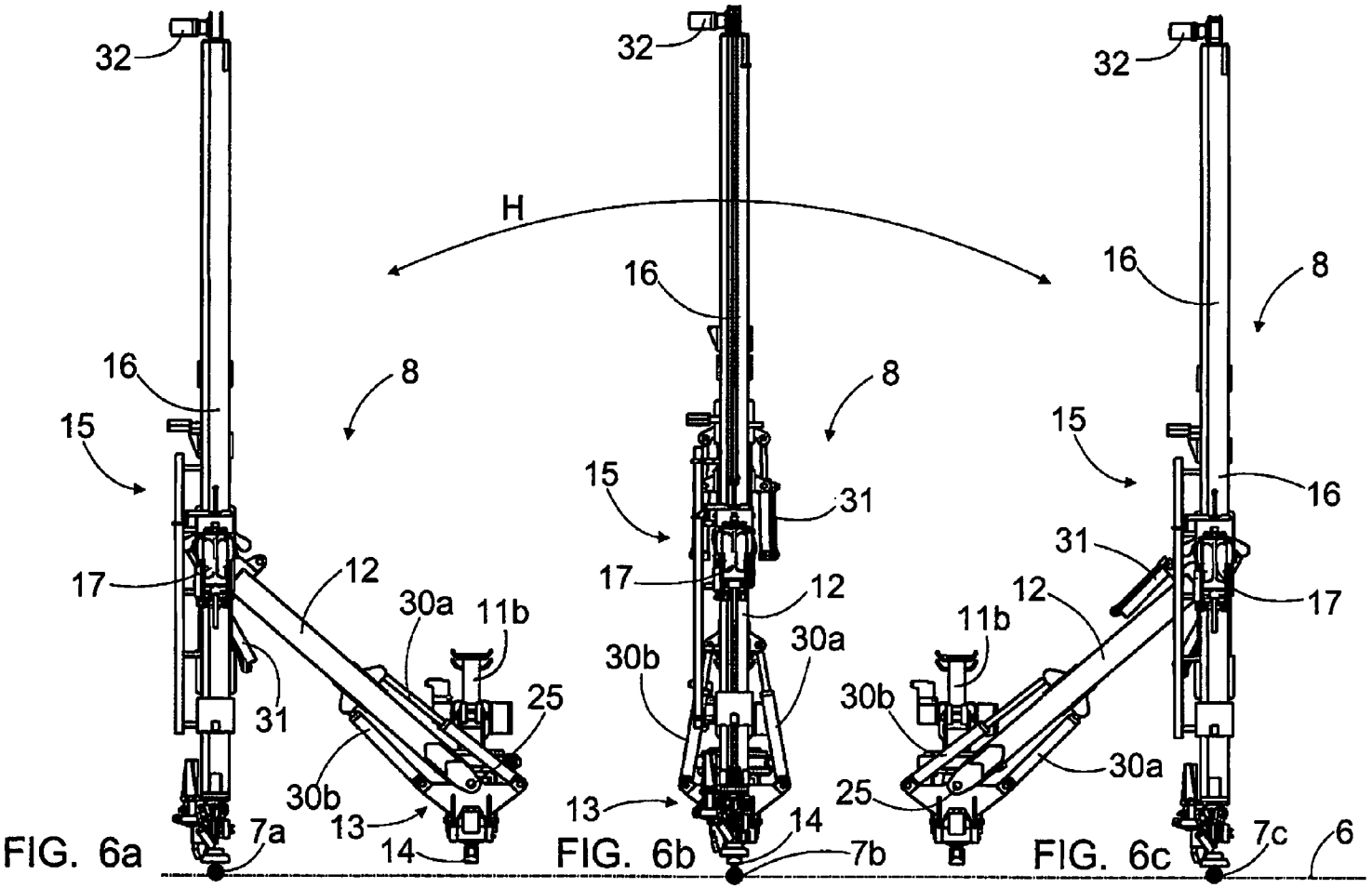

FIGS. 6*a* to 6*c* illustrate the positioning of the drilling unit 15 at the drill holes 7*a* to 7*c* on the drill hole line 6. Once the drilling apparatus 8 is coarse positioned in the vicinity of the drill hole line 6 and fine positioned accurately in the direction of the drill hole line, positioning at the drill holes 7*a* to 7*c* to be drilled can be performed simply by turning the second boom 12 and then positioning the drilling unit 15 towards the stone to be drilled. Since the second boom 12 is positioned so that the first joint 25 and the second joint 26 are in perpendicular alignment relative to the drill hole line 6, the second boom 12 and the drilling unit 15 can move only in the direction of the drill hole line 6. The direction of the drill hole line 6 is transverse to the longitudinal direction of the first boom 11. The apparatus 8 may comprise an arrangement that automatically turns the drilling unit 15 relative to the turning angle of the second boom 12 after the desired position of the drilling unit 15 relative to the stone to be drilled has been selected once. Furthermore, the feed beam 16 can be moved in the linear direction against the stone, after which the drilling can be started.

The working cycle of the line drilling apparatus 8, i.e. positioning at the drill holes and drilling, may take place under manual control, semiautomatic control or fully automatically. In manual control, the operator 18 controls the actuators from a user interface in the chassis 10 or from the remote controller 19. In semiautomatic function, the operator positions the drilling unit 15 at the first drill hole, after which the control unit 20 controls the drilling working phases automatically, then positions the drilling unit 15 at the hole to be drilled next and remains waiting for an acknowledgement from the operator 18. In a semiautomatic working cycle, the operator 18 may, when desired, still change the position of the next drill hole before the drilling is continued. In fully automatic control, the control unit 20 positions the drilling unit 15 at a preselected first drill hole, performs the drilling, positions at the next determined drill hole and continues until all predetermined drill holes are drilled. The control unit 20 may be given the dimensions and directions of the drill holes, the hole spacing and the order of drilling. It is further possible to give the control unit 20 other necessary control attributes for drilling and positioning. The control unit 20 may comprise a computer, programmable logic or the like, in which programs possessing different control strategies may be executed and which is able to perform computing required in the positioning.

Let it be mentioned that the first boom 11 and the second boom 12 may be telescopic booms that can be made longer and shorter. However, the second boom 12 has no turnable joints between the first joint 25 and the second joint 26. If need be, other joints may exist in connection with the joint mechanism 13 than those shown in the figures and, furthermore, instead of the joints presented, some other joints and joint mechanisms suitable for the purpose may be used.

In some cases, the features disclosed in the present application can be used as such, irrespective of the other features.

On the other hand, the features disclosed in the present application may be combined, if need be, for generating various combinations.

Furthermore, the line drilling device disclosed in the present application may be applied to other drilling than the drilling of dimensional stone.

The drawings and the related description are only intended to illustrate the idea of the invention. The details of the invention may vary within the scope of the claims.

What is claimed is:

1. A method of quarrying dimensional stone, the method comprising:

drilling a plurality of drill holes in a rock or a stone block in at least one drill hole line, at a desired hole spacing from each other;

using a line drilling apparatus for the drilling, which comprises at least one boom provided with at least one drilling unit, which, in turn, comprises a rock drilling machine, a feed beam and a feeding apparatus;

positioning the drilling unit in the drill hole line by means of the boom from a drilled drill hole to a drill hole to be drilled next;

detaching a dimensional stone block after the drilling from a position determined by the drill hole line;

using a line drilling apparatus comprising a first boom, a second boom, a substantially horizontal first joint between the booms and a substantially horizontal second joint between the second boom and the drilling unit;

supporting a stone support between the first boom and the second boom against the stone;

performing positioning of the line drilling apparatus to the vicinity of a drill hole line so that the first joint and the second joint are in perpendicular alignment relative to the drill hole line to be drilled and keeping this position unchanged until the drilling is completed;

performing a fine positioning of the line drilling apparatus by simultaneously moving the second boom and the drilling unit coupled thereto in a linear direction relative to the first boom;

performing positioning of the drilling unit between the drill holes belonging to the drill hole line by turning the second boom around the first joint, whereby the second boom moves only in the direction of the drill hole line and the drilling unit in the second boom turns along an arched motion path; and adjusting the position of the drilling unit, at each drill hole to be drilled, relative to the object to be drilled by turning the drilling unit relative to the second joint.

2. A method as claimed in claim 1, comprising performing the fine positioning by simultaneously moving the second boom and the drilling unit coupled thereto around at least one joint relative to the first boom.

3. A method as claimed in claim 1, comprising performing linear movement of the drilling unit towards the rock and relative to the second boom when the drilling unit is positioned to be in the direction of the hole to be drilled in the drill hole line.

4. A line drilling apparatus comprising:

at least one boom having a fastening part from which it can be fastened to a basic machine, such as onto a movable carrier;

at least one drilling unit arranged in a boom, the drilling unit comprising a feed beam, a rock drilling machine and a feeding device, the rock drilling machine being movable by means of the feeding device and supported by the feed beam;

a first boom and a second boom, and between the booms is arranged a joint mechanism comprising at least one substantially horizontal first joint around which the second boom is turnable in a transverse direction relative to the longitudinal axis of the first boom;

between the first boom and the second boom is arranged at least one stone support that is supportable against rock to be drilled for the duration of the drilling;

between the second boom and the drilling unit is arranged a substantially horizontal second joint around which the drilling unit is turnable relative to the second boom;

the second boom is a longitudinal element without any joints between the first joint and the second joint;

the positioning of the drilling unit at the drill holes according to a drill hole line is arranged to be carried out by turning the second boom only in the direction of the drill hole line; and the position of the drilling unit at each drill hole to be drilled is arranged to be set by turning the drilling unit relative to the second boom;

wherein in connection with said joint mechanism is arranged a linear joint enabling a simultaneous movement of the second boom and the drilling unit in a linear direction relative to the first boom.

5. A line drilling apparatus as claimed in claim 4, wherein in connection with said joint mechanism is arranged at least one substantially vertical joint around which the second boom and the drilling unit are simultaneously turnable.

6. A line drilling apparatus as claimed in claim 4, wherein in connection with said joint mechanism is arranged at least one substantially horizontal joint around which the second boom and the drilling unit are simultaneously tiltable.

7. A line drilling apparatus as claimed in claims 4 to 6, wherein between the first boom and said joint mechanism is arranged at least one substantially horizontal joint around which the joint mechanism is turnable.

8. A line drilling apparatus as claimed in claim 4, wherein the feed beam is arranged by means of a linear joint in the second joint.

9. A line drilling apparatus as claimed in claim 4, wherein the second boom is a one-piece rigid element.

10. A method as claimed in claim 1, wherein the performing the fine positioning includes simultaneously moving the second boom and the drilling unit coupled thereto without moving the first boom, and the linear direction is identical for both the second boom and the drilling unit.

11. A line drilling apparatus as claimed in claim 4, wherein the linear joint enables the simultaneous movement of the second boom and the drilling unit in the linear direction without moving the first boom, and the linear direction is identical for both the second boom and the drilling unit.

* * * * *